US008065971B2

(12) United States Patent
Loisel, Jr.

(10) Patent No.: US 8,065,971 B2
(45) Date of Patent: Nov. 29, 2011

(54) BOAT FENDER POSITIONING PROCESS

(76) Inventor: Robert W. Loisel, Jr., Winter Springs, FL (US)

( * ) Notice: Subject to any disclaimer, the term of this patent is extended or adjusted under 35 U.S.C. 154(b) by 164 days.

(21) Appl. No.: 12/592,953

(22) Filed: Dec. 7, 2009

(65) Prior Publication Data

US 2011/0132249 A1 Jun. 9, 2011

(51) Int. Cl.
*B63B 59/02* (2006.01)

(52) U.S. Cl. ..... 114/219; 114/220; 114/223; 24/129 R

(58) Field of Classification Search ..... 114/219, 114/220, 381, 213, 215, 223, 205, 218, 230.1, 114/230.2; 24/115 H, 129 R
See application file for complete search history.

(56) References Cited

U.S. PATENT DOCUMENTS

| | | | | | |
|---|---|---|---|---|---|
| 59,277 | A | * | 10/1866 | Sawyer | 24/129 R |
| 71,393 | A | * | 11/1867 | Kuntz | 294/74 |
| 178,373 | A | * | 6/1876 | Knight | 114/223 |
| 363,352 | A | * | 5/1887 | Avery | 403/208 |
| 434,888 | A | * | 8/1890 | Ross | 188/65.4 |
| 518,880 | A | * | 4/1894 | Evans | 114/223 |
| 556,485 | A | * | 3/1896 | Wilson | 24/129 R |
| 649,458 | A | * | 5/1900 | Ives | 188/65.4 |
| 678,533 | A | | 7/1901 | Bancker | |
| 785,019 | A | * | 3/1905 | Parker | 188/65.4 |
| 794,916 | A | * | 7/1905 | Barrett | 402/78 |
| 872,355 | A | * | 12/1907 | Le Maire | 24/129 R |
| 904,843 | A | * | 11/1908 | Cooper | 24/129 R |
| 1,072,556 | A | * | 9/1913 | Wood | 24/130 |
| 1,114,392 | A | * | 10/1914 | Shuart | 182/193 |
| 1,153,053 | A | * | 9/1915 | Forster | 43/44.85 |
| 1,407,406 | A | * | 2/1922 | Glazebrook | 24/129 R |
| 1,583,343 | A | * | 5/1926 | Duerden | 24/129 R |
| 2,151,664 | A | * | 3/1939 | Redfield | 24/129 R |
| 2,345,890 | A | * | 4/1944 | Daniels et al. | 24/129 R |
| 2,466,083 | A | * | 4/1949 | Crosby | 24/129 B |
| 2,601,083 | A | * | 6/1952 | Brouse | 74/502.5 |
| 2,878,013 | A | * | 3/1959 | Piodi | 267/69 |
| 3,575,371 | A | * | 4/1971 | Carlstedt | 248/215 |
| 3,631,570 | A | * | 1/1972 | Coleman | 24/129 R |
| 3,650,236 | A | * | 3/1972 | McFarlane | 114/218 |
| 3,911,610 | A | * | 10/1975 | Goodman | 43/43.1 |
| D248,367 | S | * | 7/1978 | Haft | D8/356 |
| 4,280,435 | A | * | 7/1981 | Loomis | 114/219 |
| 4,414,712 | A | * | 11/1983 | Beggins | 24/129 R |
| 4,895,094 | A | * | 1/1990 | Carlstedt | 114/218 |
| 4,953,576 | A | * | 9/1990 | Connelly | 135/118 |
| 4,998,495 | A | * | 3/1991 | Bos et al. | 114/218 |
| 5,016,554 | A | * | 5/1991 | Harris et al. | 114/219 |
| 5,327,847 | A | * | 7/1994 | Cook | 114/218 |
| D357,404 | S | * | 4/1995 | Doyle | D8/373 |
| 5,493,983 | A | * | 2/1996 | Hurt | 114/364 |
| D375,924 | S | * | 11/1996 | Kramer | D12/168 |
| 5,596,791 | A | * | 1/1997 | Parsons | 24/130 |
| 5,625,925 | A | * | 5/1997 | Richards | 24/129 B |
| 5,660,133 | A | * | 8/1997 | Munich | 114/219 |
| 5,987,711 | A | * | 11/1999 | Parsons | 24/130 |
| 6,094,783 | A | * | 8/2000 | Parsons | 24/130 |
| 6,152,060 | A | * | 11/2000 | Steiner | 114/219 |

(Continued)

*Primary Examiner* — Lars A Olson
*Assistant Examiner* — Andrew Polay
(74) *Attorney, Agent, or Firm* — William M. Hobby, III

(57) ABSTRACT

A method for adjustably positioning a boat fender on the side of a boat utilizes a flexible strap having a plurality of openings therein having a boat fender rope threaded therethrough. The boat fender rope can be quickly moved through the openings in the strap to raise or lower the boat fender to lock the boat fender in place on the side of the boat.

8 Claims, 5 Drawing Sheets

U.S. PATENT DOCUMENTS 6,317,935 B1 * 11/2001 O'Rouke ..... 24/129 R
6,604,482 B1 * 8/2003 Martello ..... 114/218
D481,002 S * 10/2003 Sherman et al. ..... D12/317
7,143,708 B1 * 12/2006 Cimino ..... 114/219
D557,652 S 12/2007 Gassew
D585,357 S * 1/2009 Volkwein ..... D12/317
7,594,923 B2 * 9/2009 Fallin et al. ..... 606/232
2004/0034972 A1 * 2/2004 Brown ..... 24/129 R

* cited by examiner

BOAT FENDER POSITIONING PROCESS

BACKGROUND OF THE INVENTION

The present invention relates to a method for adjustably positioning a boat fender on the side of a boat and especially to a method which utilizes a flexible strap having a plurality of openings therein having a boat fender rope threaded therethrough which can be quickly moved through the openings in the strap and locked in place to position the boat fender in place on the side of a boat.

In the past, it has been common to use boat fenders along the sides of a boat to protect the hull from damage caused by collision with moorings. To increase the effectiveness of the boat fenders requires that the vertical length of the boat fender rope supporting the boat fender be vertically adjusted for each boat fender in accordance with mooring height variations and in accordance with the ocean tide and the like. It has been common in the past to anchor boat fenders by attaching the boat fender ropes to deck cleats or other rope fastening means on the boat. This requires tying and untying the ropes from the cleats or anchoring device to continuously adjust the height of the boat fender adjacent the side of the boat. This is time consuming and awkward especially during docking maneuvers when appropriate positioning of the boat fenders have to be initially ascertained.

A wide variety of other types of boat fender fastening means have been provided in an attempt to eliminate the tying and untying of fender lines to the boat cleats or to boat hand rails. Many of these replacements become more complex and sometimes more time consuming and sometimes involving many parts, such as cams for locking ropes in place.

Typical prior art means for tethering a boat fender over the side of a boat and holding the boat fender in place include the Loomis U.S. Pat. No. 4,280,435 which is a one piece anchor for adjustably tethering a rope suspended boat fender. This patent has a one piece anchor of a rigid material which has a hook formed on one end for clipping onto a rod. An extended anchor portion has three openings therein spaced for threading a boat anchor rope to position the boat fender. In the Volkwein U.S. Design Pat. No. D585,357, a watercraft fender hook is provided which is similar to the Loomis patent in that it has a one piece fender hook which has a hooked end for clipping over a boat rail with an extended rigid member having a plurality of holes for threading a rope through.

In the Bancker U.S. Pat. No. 678,533, a rope fastener is provided having a plurality of openings in a cast metal member for threading rope through the openings. In the Sherman et al. U.S. Design Pat. No. D481,002, a boat fender support has three openings therein. A similar boat fender mounting device may be seen in the Cimino U.S. Pat. No. 7,143,708 in which the boat fender mounting device has a planar member with a slot for the rail cable and at least one rope aperture for receipt and retention of the one end of the rope. In the Doyle U.S. Design Pat. No. Des 357,404, a boat fender strap is supported with suction cups. In the Carlstedt U.S. Pat. No. 4,895,094, a fender hanger assembly has a metal clip which has three openings therein for tying a boat fender rope thereto. In the Kramer U.S. Design Pat. No. 375,924, a boat fender strap is made for attaching to the boat with a suction cup.

Other U.S. patents for boat fender hangers or rope clamps may be seen in the Cook U.S. Pat. No. 5,327,847 for an apparatus for fastening and adjusting a line and in the Haft U.S. Design Pat. No. Des. 248,367 for a hanger for a boat fender and the like and in the Martello U.S. Pat. No. 6,604,482 for a hanger for securing a line to a cleat. Also in the Gassew U.S. Design Pat. No. D557,652 for a boat fender hook and in the Bos et al. U.S. Pat. No. 4,998,495 for a fender hanger and in the Parsons U.S. Pat. No. 6,094,783 for a rope clamp and in the McFarlane U.S. Pat. No. 3,650,236 for a marine line holder and the Parsons U.S. Pat. No. 5,596,791 for a rope clamp and the Munich U.S. Pat. No. 5,660,133 for a fender mounting system and method for boats.

The present boat fender strap allows for a fast attachment and detachment to a boat railing for a boat. The fender strap allows the boat fender to be rapidly raised or lowered by the boat fender rope being threaded through a plurality of openings in a flexible strap. The process then allows the boat strap to be folded to align all of the openings therein for easily sliding the rope therethrough until the fender reaches the proper position and then releasing the folded flexible boat fender strap to lock the fender rope and boat fender in place.

SUMMARY OF THE INVENTION

A method for adjustably positioning a boat fender on the side of a boat includes selecting an elongated flexible boat fender strap having attaching means for attaching one end to a boat rail and having an elongated portion having a plurality of spaced openings therein. The process includes selecting a boat fender having a flexible rope attached thereto and extending therefrom. The boat fender flexible rope is threaded or laced through the plurality of spaced openings the elongated flexible boat fender strap. The boat fender flexible strap can be folded to align the plurality of openings therethrough to allow sliding the boat fender flexible rope through the aligned openings to adjust the position of the boat fender on the side of the boat. The folded elongated flexible boat fender straps are released to extend and lock the boat fender flexible rope to the elongated flexible boat fender strap to lock the boat fender in place on the side of the boat. This allows a boat fender to be rapidly positioned on the side of the boat. The spaced openings in the boat fender straps have grommets in the openings in the strap. The strap attaching means may be hook and loop and buckle strap and a separate loop may be formed on the end of the strap for holding excess rope. The rope threaded through the openings may be knotted at one end. The flexible strap can have a second loop at the other end thereof.

BRIEF DESCRIPTION OF THE DRAWINGS

Other objects, features, and advantages of the present invention will be apparent from the written description and the drawings in which.

DESCRIPTION OF THE PREFERRED EMBODIMENTS

The present invention relates to a process for adjustably positioning a boat fender on the side of a boat utilizing an elongated flexible boat fender strap having means for attaching the strap to a boat rail.

Figure 1:
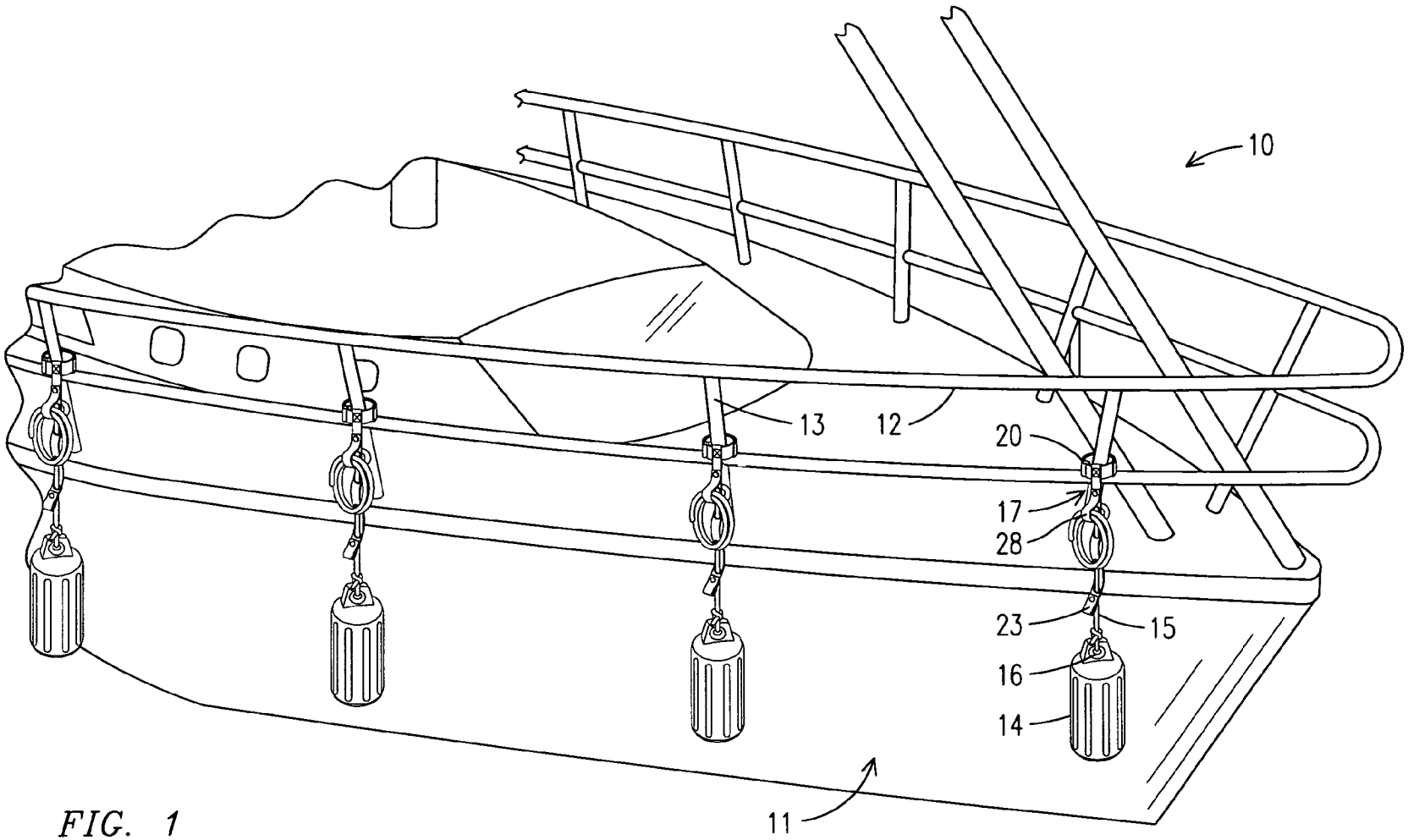
FIG. 1 is a perspective view of a portion of a yacht having a plurality of boat fenders held by the present boat fender strap.
Figure 2:
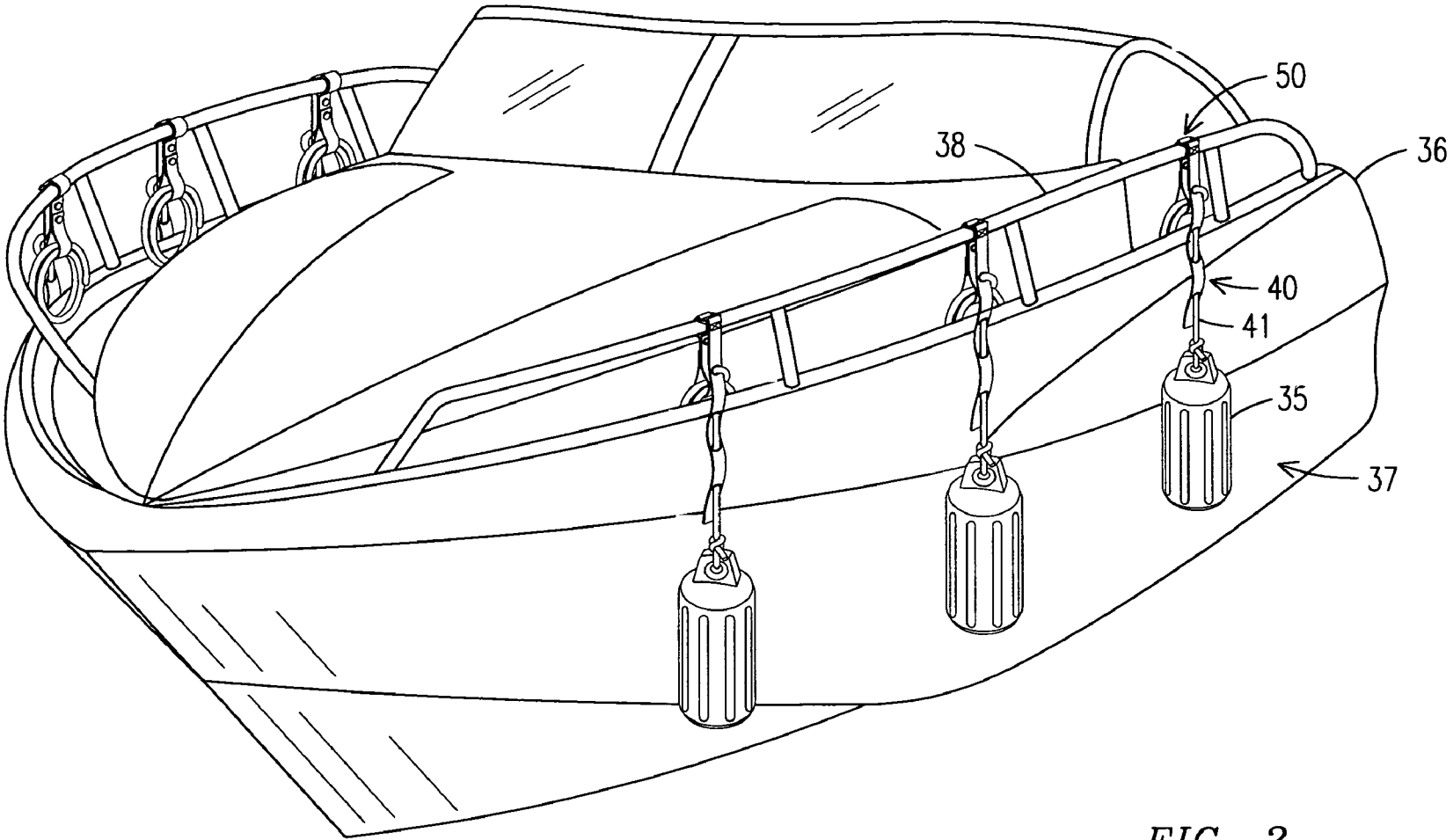
FIG. 2 is a perspective view of a portion of a boat having the boat fender straps attached to the hand rail on the boat.

Referring to the drawings and especially to FIGS. 1 and 3 through 5, a boat or yacht 10 is illustrated having a hull 11 and a boat rail 12 which includes a boat rail post 13. The boat 10, as shown in FIG. 1, has a plurality of boat fenders 14 supported on the side of the hull 11 by boat fender ropes 15. The boat fender rope 15 is tied through an aperture 16 to the boat fender 14 and is used to raise or lower the boat fender 14. A boat fender strap 17 is attached to the boat hand rail 12 post 13, as seen in FIG. 1. The boat fender strap 17 has an elongated strap portion 18 having a boat rail attaching means 20. The strap 18 has a plurality of apertures 21, each of which has a grommet 22 therein.

The flexible strap 17 can be made of any flexible fabric or webbing material desired. A loop 23 is formed at one end of the strap by bending the end of the strap around and attaching with a snap fastener 24.

Figure 5:
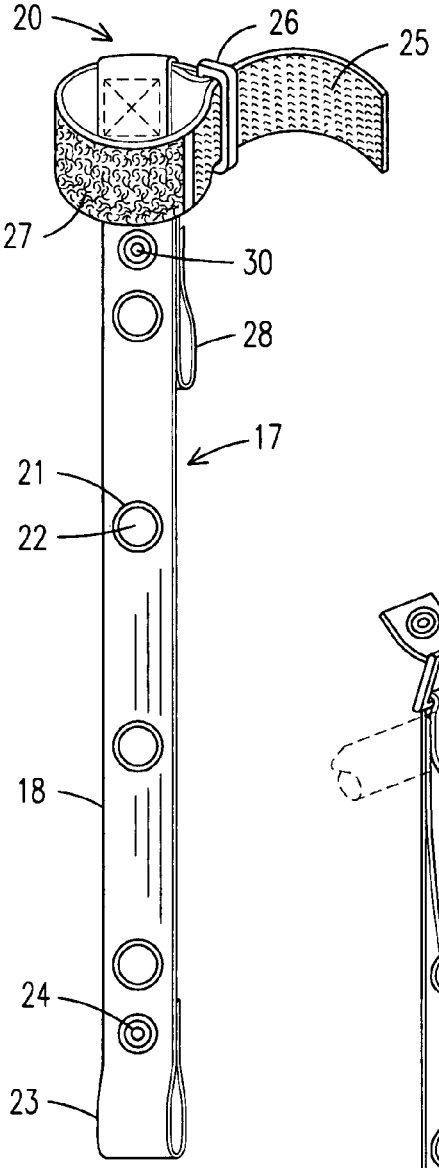
FIG. 5 is a perspective view of the boat fender strap of FIG. 4 having the means for attaching the boat fender strap to a boat rail partially open.
Figure 6:
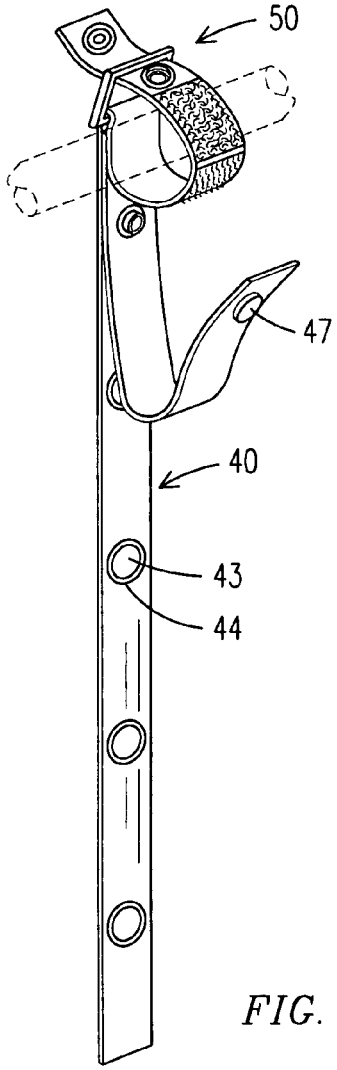
FIG. 6 is a perspective view of the boat fender strap of FIGS. 1 through 5 being attaching to a boat railing.
Figure 7:
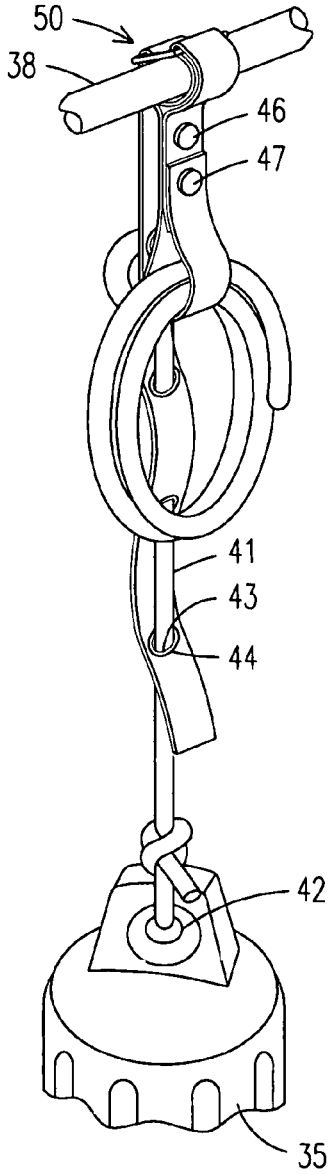
FIG. 7 is a perspective view of a boat fender attached with the present boat fender strap to a boat railing.

The rail attaching means 20 on the opposite end of the elongated strap portion 18 is a buckle and VELCRO or hook and loop strap, as more clearly seen in FIG. 5. The end of the strap has hook and loop material 25 passing through a buckle 26 where it is attached to the hook and loop material 27 to give a secure lock onto the boat rail post 13, as shown in FIG. 3.

Figure 3:
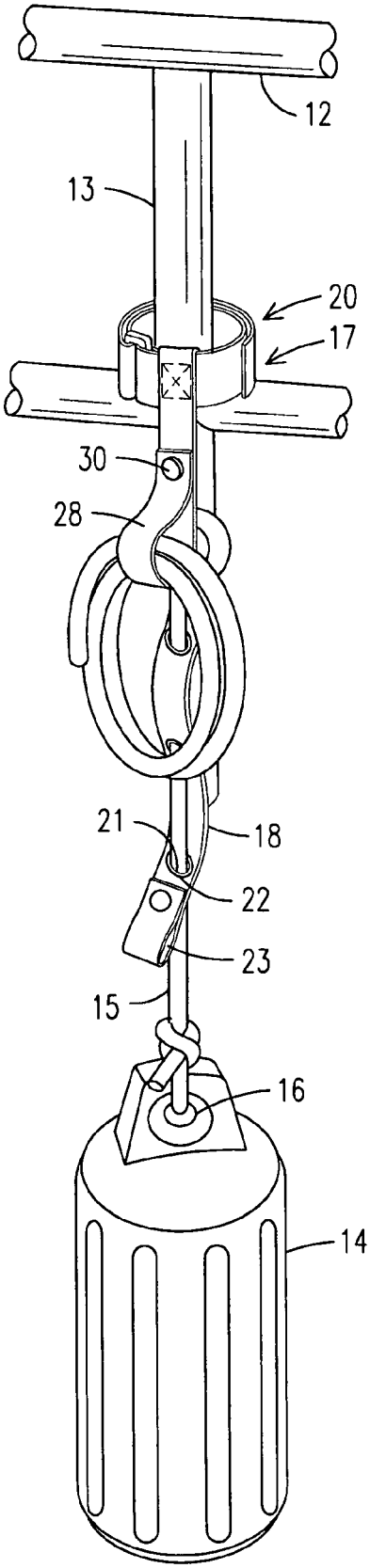
FIG. 3 is a perspective view of a boat fender held to a boat hand rail with the present boat fender strap.
Figure 4:
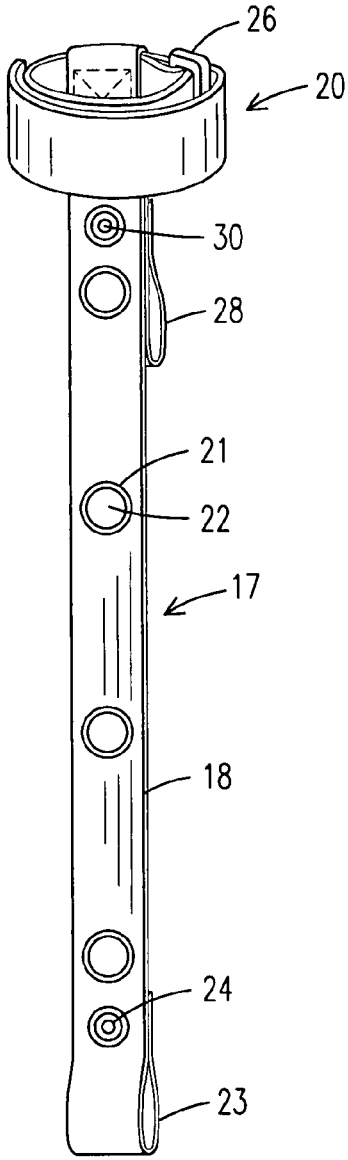
FIG. 4 is a perspective view of the boat fender strap in accordance with the present invention.

In FIG. 3, the boat fender 14 has the supporting rope 15 tied through the opening 16. The rope has been threaded through the grommets 22 of the apertures 21 in the strap portion 18. After threading the rope 15 through the openings in the strap 17, the excess rope can then be wrapped and held in an excess rope holding loop 28. Loop 28 is formed with a piece of flexible strap material which is looped and attached to the strap 17 with a snap fastener 30 to form a loop for holding the excess rope. The rope extending through the strap apertures when the strap portion 18 is extended locks the rope in place to lock the boat fender in place. Moving the rope through the strap portion 18 raises or lowers the boat fender 14 to position the boat fender on the boat in the proper position to prevent the boat bumping against the mooring for the boat.

Referring more specifically to FIGS. 2 and 7 through 9, a plurality of boat fenders 35 can be seen supported along a boat 36 hull 37 and supported to the boat rail 38. The boat fender rope strap 40 is attached to the boat rail in this case, rather than to the post railing post 13. Boat fender 35 has a boat fender rope 41 attached to the boat fender 35 opening 42 and extending through openings 43 having grommets 44 in the flexible elongated strap 40. The excess rope can be seen supported in a fabric loop 45 which is attached to the strap 40 with a rivet 46 and has a loop in the fabric and a snap fastener 47 for forming the loop. The flexible boat fender strap attaching means 50 is also a VELCRO and buckle attachment, the same as that shown in FIG. 5, except that it is positioned to attach to the horizontal extending rail 38 rather than to the rail post.

Figure 8:
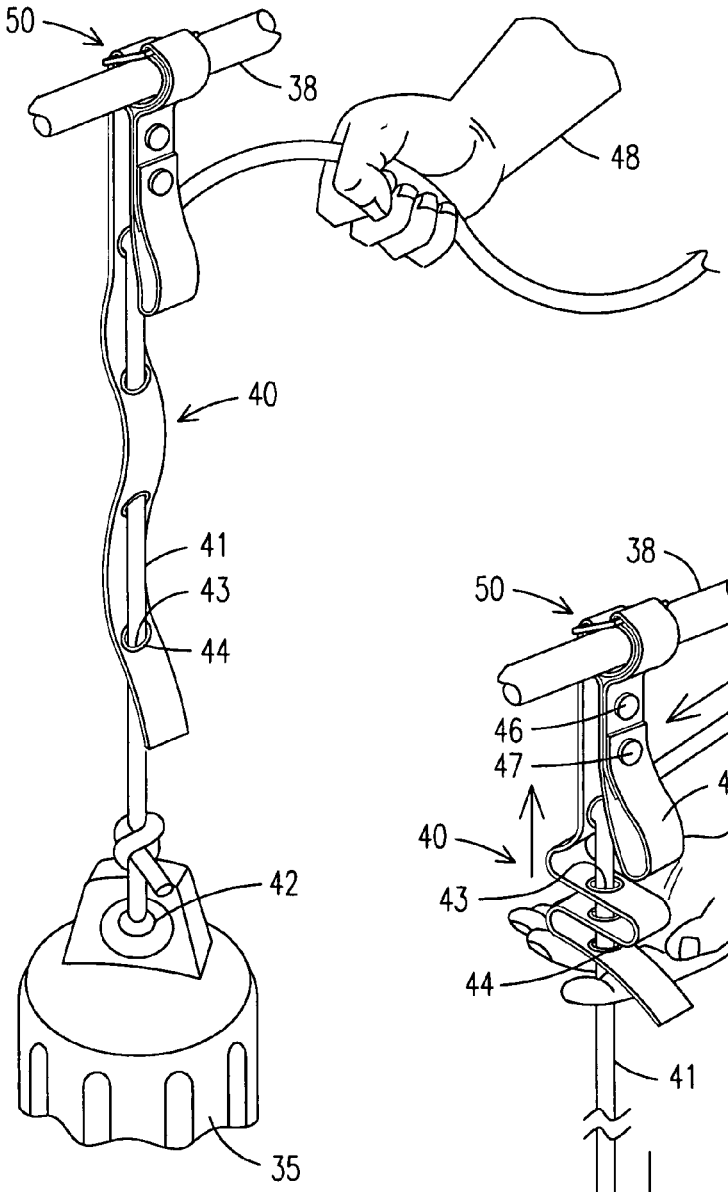
FIG. 8 is a perspective view of a boat fender rope being threaded through the openings in the boat fender strap of FIGS. 1 through 7.
Figure 9:
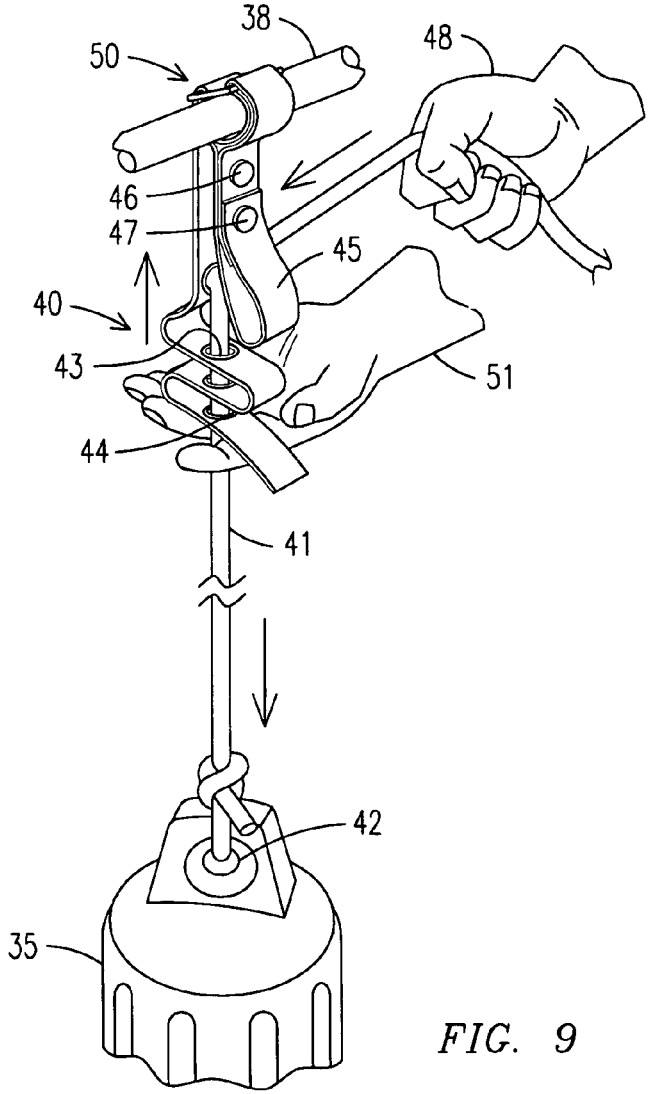
FIG. 9 is a perspective view of the boat fender of FIG. 8 being positioned on the side of a boat by raising or lowering the boat fender rope through the openings of the boat fender strap.

Referring to FIGS. 8 and 9, the process of the present application is better illustrated in which FIG. 8 is a perspective view of the boat fender rope holding strap 40 having the rope 41 tied at one end through the opening 42 of the boat fender 35 and threaded through the aperture 43, grommets 44 and being held by an individual's hand 48. The strap 40 rail attaching means 50 is attached to a boat rail 38. The excess rope loop 45 can be seen attached with a snap fitting 47 to the flexible boat fender rope strap 40.

In FIG. 9, the user's hand 48 is still holding the rope 41 while the person's other hand 51 is positioned under the bottom of the strap 40 and has raised strap 40 on the rope 41 aligning all of the openings 43 and grommets 44 into an axial line in which the rope 41 can be easily raised up or down with the man's hand 48. Once the rope has been raised or lowered to a position to adjust the fender 35, the hand 51 can be removed to release the folded strap 40. This will extend the strap 40, as shown in FIG. 8, which locks the rope fender 35 rope 41 into position holding the boat fender 35 into position. The user's hand 51 can then be used to pull the strap 40 taut by pulling on the loop 23. This further tightens the rope 41 to the strap 40. The top opening of the plurality of openings 43 does not have to be folded into alignment in order to let the hand 48 extend to one side when supporting the rope 41 and the boat fender 35.

Thus, the process includes selecting an elongated flexible boat fender strap 40 having an attaching means 50 for attaching one end to a boat rail 38. The elongated portion of the strap 40 has a plurality of spaced apertures 43 with grommets 44. The boat fender 35 has a flexible rope 41 attached thereto and extending therefrom and the flexible rope is threaded or laced through the aperture 43 and grommets 44 in the flexible strap 40. A person's hand 48 can then hold the elongated flexible strap 40 to align the plurality of apertures 43 therethrough to allow the rope 41 to easily go up or down through the openings 43. Rope 41 is then slid to adjust the position of the boat fender 35 on the side of a boat. The folded elongated flexible boat fender strap 40 is then released and expanded to hold the boat fender 35 in place by the weigh to the boat fender pulling on the strap 40. This allows a boat fender to be rapidly positioned on the side of the boat. A knot can be tied in the rope 41 as an extra precaution to prevent the fender 35 from accidentally slipping and for added protection in extreme weather or for long periods of time.

It should be clear at this time that a method for adjustably positioning a boat fender on the side of a boat has been provided for the rapid positioning of the boat fender on the side of a boat. However, the present invention should not be considered as limited to the forms shown which are to be considered illustrative rather than descriptive.

I claim:

1. A method for adjustably positioning a boat fender on the side of a boat comprising the steps of:

selecting an elongated flexible boat fender strap having attaching means for attaching one end to a boat rail and having an elongated portion having a plurality of spaced openings therein;

selecting a boat fender having a flexible rope attached thereto and extending therefrom;

threading said boat fender flexible rope through the plurality of spaced openings in said elongated flexible boat fender strap;

folding said elongated flexible fender strap in folds to align a plurality of openings therethrough;

sliding said boat fender flexible rope through the aligned openings to adjust the position of said boat fender on the side of a boat; and releasing said folded elongated flexible boat fender strap having said boat fender flexible rope laced therethrough to extend and lock said boat fender flexible rope to said elongated flexible boat fender strap;

whereby a boat fender is rapidly positioned on the side of a boat.

2. The method for adjustably positioning a boat fender on the side of a boat in accordance with claim 1 including the step of attaching said elongated flexible boat fender strap to a boat railing with a hook and loop strap.

3. The method for adjustably positioning a boat fender on the side of a boat in accordance with claim 1 including the step of attaching said elongated flexible boat fender strap to a boat railing with a buckling strap.

4. The method for adjustably positioning a boat fender on the side of a boat in accordance with claim 1 in which the selected elongated flexible boat fender strap plurality of spaced openings each has a grommet therein.

5. The method for adjustably positioning a boat fender on the side of a boat in accordance with claim 4 in which said selected elongated flexible boat fender strap has an excess rope holder on one end thereof for holding excess boat fender flexible rope.

6. The method for adjustably positioning a boat fender on the side of a boat in accordance with claim 5 in which said selected elongated flexible boat fender strap excess rope holder is a looped strap.

7. The method for adjustably positioning a boat fender on the side of a boat in accordance with claim 6 in which said selected elongated flexible boat fender strap excess rope holder is a looped strap having a snap fastener for releasably holding excess boat fender flexible rope therein.

8. The method for adjustably positioning a boat fender on the side of a boat in accordance with claim 1 including the step of knotting said boat fender flexible rope laced through said plurality of spaced opening in said elongated flexible boat fender strap.

* * * * *